US005636574A

United States Patent [19]

Pierrot

[11] Patent Number: 5,636,574

[45] Date of Patent: Jun. 10, 1997

[54] RAILROAD TIE PLUGGING DEVICE

[76] Inventor: Edwin A. Pierrot, 144 S. Golfview Rd., Pueblo West, Colo. 81007

[21] Appl. No.: 613,229

[22] Filed: Mar. 8, 1996

[51] Int. Cl.[6] ..... E01B 31/00

[52] U.S. Cl. ..... 104/17.1

[58] Field of Search ..... 104/17.1, 17.2; 221/9, 10, 156, 171, 173, 174, 290, 294, 296; 227/135

[56] References Cited

U.S. PATENT DOCUMENTS

| | | | |
|---|---|---|---|
| 3,717,101 | 2/1973 | Katcha et al. | 104/17.1 |
| 3,753,405 | 8/1973 | Bryan | 104/17.1 |
| 4,131,066 | 12/1978 | Lund | 104/17.1 |
| 4,152,558 | 5/1979 | Newman | 104/17.1 |
| 5,191,840 | 3/1993 | Cotic et al. | 104/17.1 |
| 5,487,341 | 1/1996 | Newman et al. | 104/17.1 |
| 5,542,355 | 8/1996 | Madison et al. | 104/17.1 |

*Primary Examiner*—Mark T. Le

[57] ABSTRACT

The present invention comprises a device for automatically inserting wooden railroad tie plugs without the need for multiple crew members of intense labor. The device comprises a feeding mechanism adapted to place a wooden tie plug to be inserted into a gun adjacent a spike hole over a railroad tie. A horizontal positioning ram and insertion tube cooperate to ensure the tie is properly positioned and an attendant vertically mounted ram forces the wooden tie plug into the spike hole, thereby rehabilitating the railroad tie and placing it in a condition for respiking.

24 Claims, 4 Drawing Sheets

RAILROAD TIE PLUGGING DEVICE

BACKGROUND OF THE INVENTION

The present invention relates to railroad maintenance devices, and in particular to a device for automatically spotting and inserting tie plugs into railroad ties without the need for a large crew of workers and extensive labor.

Rails are fastened to underlying railroad ties through the use of metal spikes. The spikes are inserted vertically through an opening in the flange of the rail into the depth of the underlying wooden tie. Repair either to the rails or the underlying tie requires the spikes be removed for the track to be lifted, cleaned, replaced or repaired. Removal of the metal spike, of course, leaves a vertical hole in the wooden tie. Reinsertion of a spike is insufficient to firmly affix the repaired or replaced rail to the existing tie. As well, it is both expensive and infeasible to replace the underlying tie on every occasion when track is removed or replaced. Accordingly, when possible, the tie is reused.

In the prior art, the existing hole in a tie was often filled or plugged prior to laying new track and inserting new spikes. Ordinarily, crews of railroad workers, carrying a supply of wooden plugs of the approximate diameter of the opening left by the removed spikes, place the wooden plugs in the holes and pound the same into engagement. This usually requires two pairs of crews, one for each side of a double rail, and is extremely time consuming and inefficient. The procedure is also costly and not an effective use of railroad personnel. Moreover, manual spotting and pounding of the plugs is fraught with problems such as splitting of the plugs, sticking, improper or misaligned insertion, etc.

Prior art efforts to solve the problem have included the use of epoxies or compounds to fill the spike holes. These methods have proved to be more costly, difficult to administer, and have not demonstrated the durability of wooden tie plugs.

The present invention provides a mechanical device for supplying, orienting, positioning and inserting wooden tie plugs into existing spike holes through the use of a single operator, with speed and efficiency.

SUMMARY OF THE INVENTION

The present invention comprises a device mounted on a movable chassis adapted to mechanically store, feed and insert wooden railroad tie plugs through the use of a hydraulic ram. The device is operated by a single operator and is capable of being powered along railroad tracks to preselected locations. The device is further adapted to be located over a precise, preselected tie and spike hole, and insertion is accomplished automatically.

Accordingly, the object of the invention is to provide a device for inserting wooden railroad tie plugs into existing spike holes. Still another object of the invention is to provide a device that automatically inserts wooden tie plugs, through hydraulic or mechanical means, without the need for extensive crews and operators. Yet another object of the invention is to provide a device adapted to insert a wooden tie plug over a preselected spike hole and to uniformly and efficiently insert the tie plug repeatedly and without the need for human intervention.

These and other objects of the invention will become readily apparent to one of ordinary skill in the art by reference to the specification herein and to the appended drawings.

DESCRIPTION OF THE DRAWING FIGURES

DESCRIPTION OF THE PREFERRED EMBODIMENT

Figure 1:
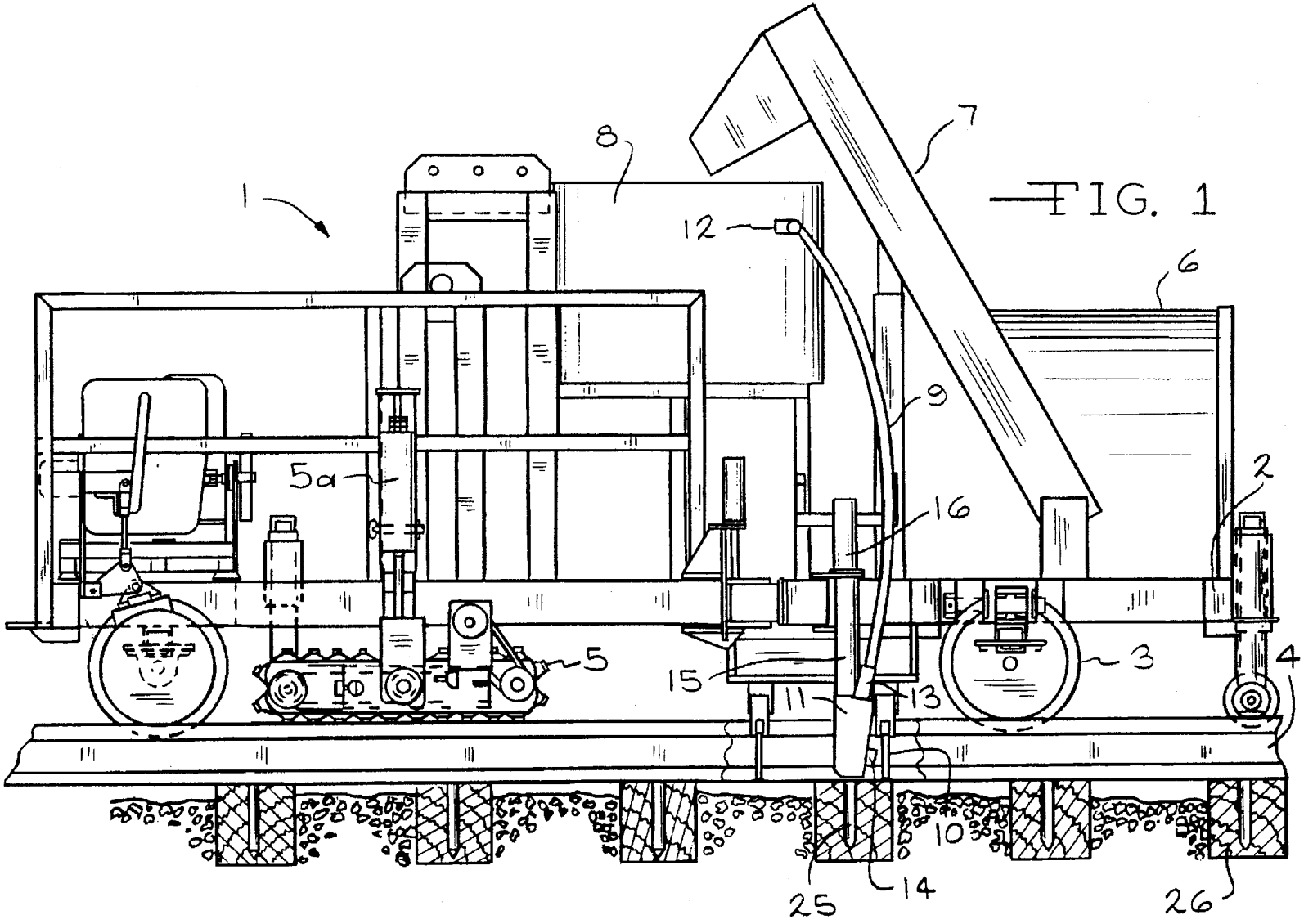
FIG. 1 is a side elevation of the chassis and device positioned over a particular railroad tie.

Adverting first to FIG. 1, the device, 1, is shown to generally include a chassis, 2, adapted to contain, arrange and support the various components of the invention. Chassis, 2, is supported along rail, 4, through wheels, 3. FIG. 1 is also shown to include a series of railroad ties, 26, having rail spike holes, 25, interposed normally therein.

Continuing to advert to FIG. 1, the general device, 1, is shown to further include an optional crawler mechanism, 5, selectively engaged through the use of lift cylinder, 5A. Crawler mechanism, 5, is used when only a single rail is available to support chassis, 2, along the track bed. In the presence of two rails, wheels, 3, are engaged and cylinder, 5A, lifts crawler mechanism, 5, clear of the rail.

Continuing to advert to FIG. 1, the device is shown to further include bulk feeder bin, 6, used to store a supply of wooden tie plugs (not shown). Conveyer, 7, is shown to extend from the internal portion of bulk feeder bin, 6, out and into a centrifugal feeder, 8. Centrifugal feeder, 8, is connected to a supply tube, 9, adapted to receive and deliver wooden tie plugs from bulk feeder, 8, to insert gun, 11, positioned over a railroad tie opening spike hole, 25.

The device further includes a tie sensing mechanism, 10, adjacent the insertion gun, 11, for automatically and precisely positioning the insertion gun, 11, over spike hole, 25, for later insertion of a wooden tie plug.

Bazooka tube, 12, is interposed between centrifugal feeder bin, 8, and supply tube, 9, and is adapted to accept a single wooden tie plug at a time for stacking within the supply tube and later insertion.

Continuing to advert to FIG. 1, supply tube, 9, is shown to terminate at its lower end in insertion tube, 13, adapted to accept a limited number of oriented tie plugs that are later interposed within insertion slot, 15, through the use of a horizontal positioning ram, 14. Once in place in insertion slot, 15, ram, 16, is automatically engaged to vertically shoot the tie plug into spike hole, 25. The specific features of the insertion mechanism and device are discussed in more detail below.

Figure 2:
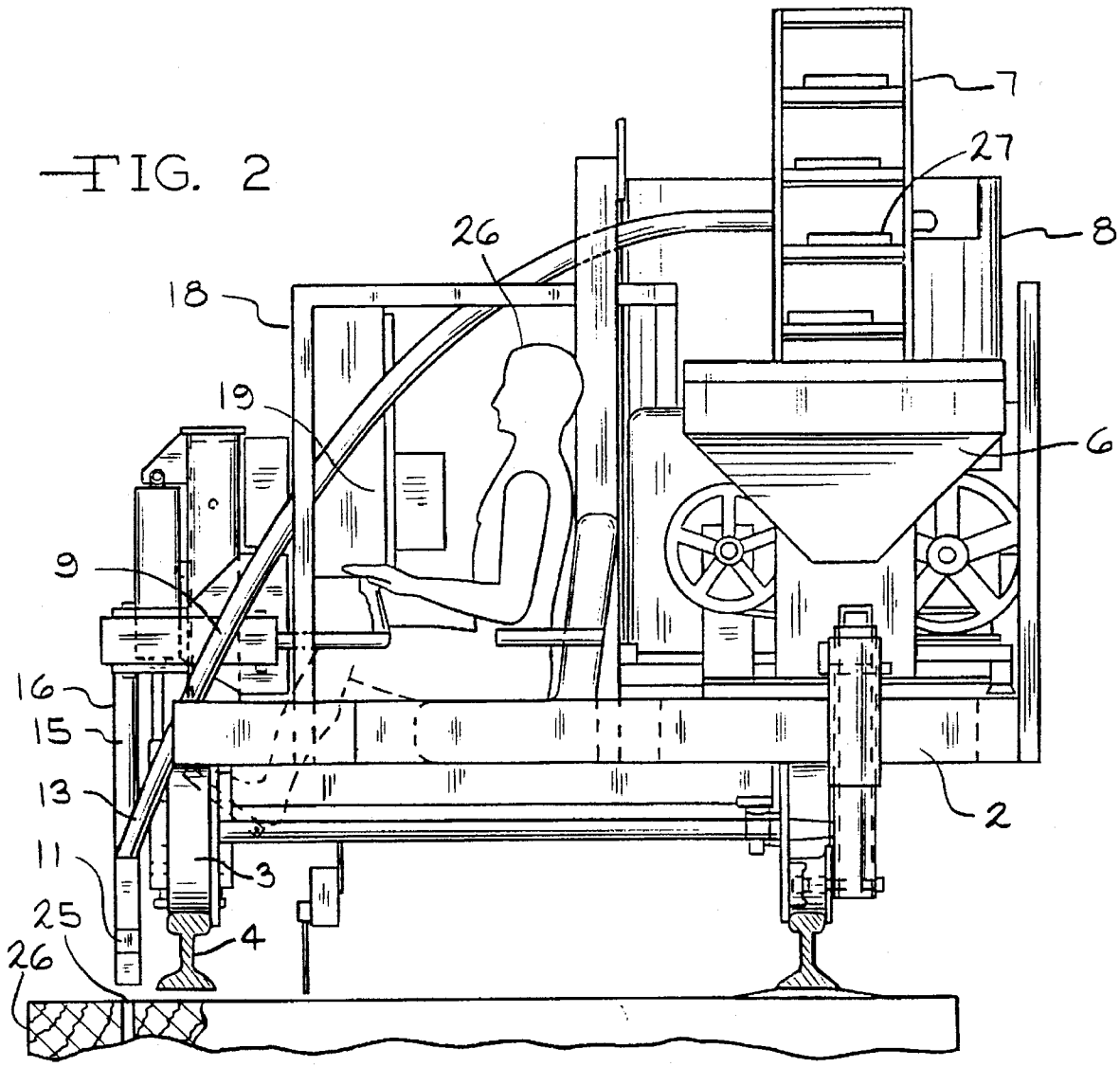
FIG. 2 is an end view and elevation of the device showing the device positioned over a particular spike hole.

Adverting next to FIG. 2, an end elevation of the device and operator in place is shown and described. In particular, operator, 26, is shown to be interposed within cab, 18, in front of control panel, 19, facing outwardly over track, 4. Bulk feeder, 6, and conveyor, 7, are shown to empty tie plugs, 27, into centrifugal feeder, 8, and ultimately into supply tube, 9, communicating with insertion gun, 11. Insertion gun, 11, is positioned over spike hole, 25, and railroad tie, 26. Insertion slot, 15, and attendant ram, 16, are shown to communicate with insertion tube, 13, as described in more detail in FIG. 4. Accordingly, as shown and described in FIG. 2, a single operator is capable of automatically maneuvering and positioning the device over the spike hole to be filed, and no other crew members are required to operate the device.

Figure 3:
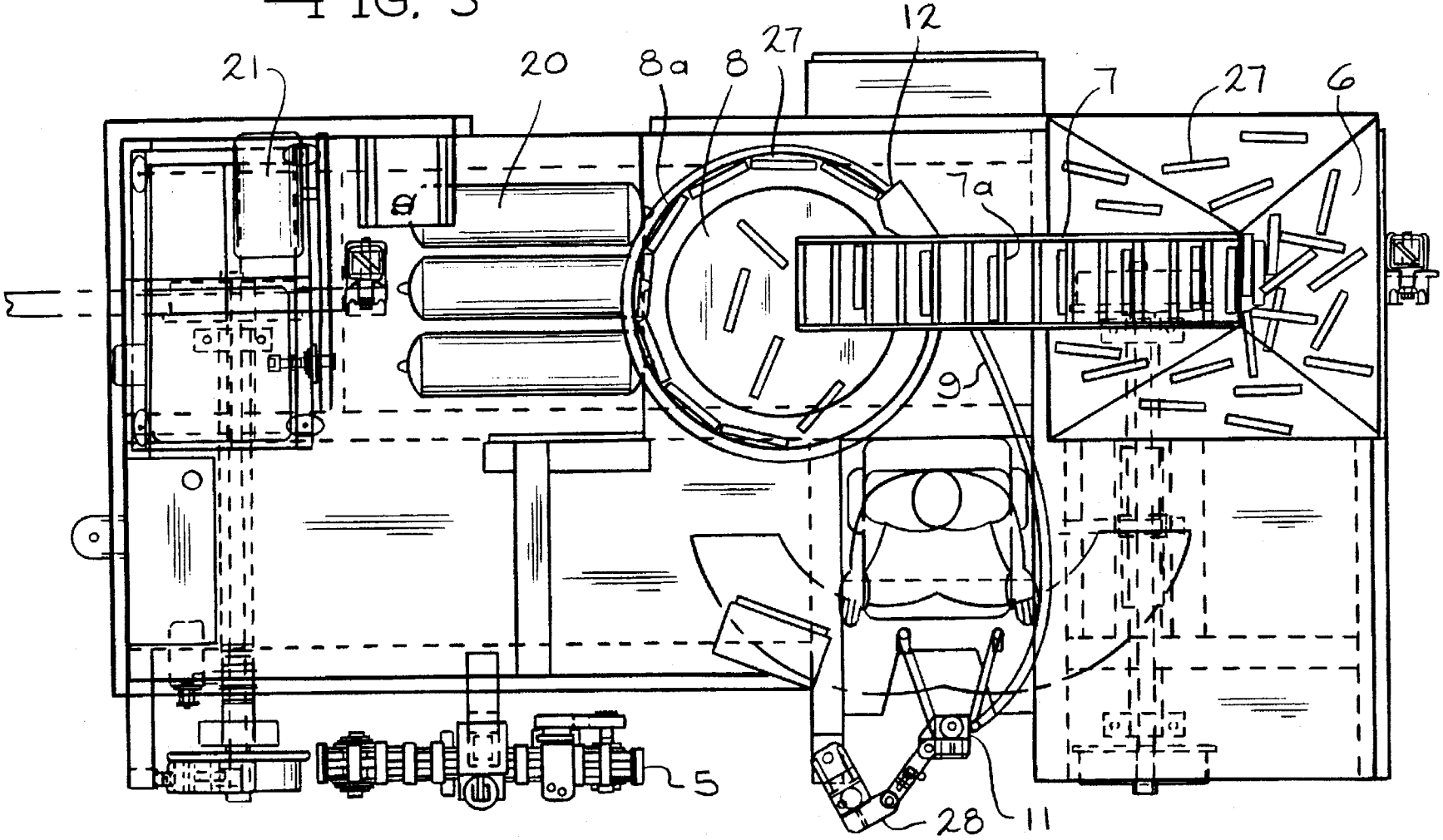
FIG. 3 is a top plan view of the device showing tie plugs being fed to the container for later insertion.

Adverting next to FIG. 3, wooden tie plugs are shown to be stored in bulk feeder, 6. An automatic sensor (not shown) activates conveyer, 7, and the series of tie plugs, 27, are captured on conveyer steps, 7A, and they are thereby lifted upward out of bulk feeder, 6, and are dumped into centrifugal feeder, 8. Centrifugal feeder, 8, is adapted to spin at a rapid speed thereby forcing wooden tie plugs, 27, to the outer most rim, 8A, of the centrifugal feeder mechanism. Bazooka tube, 12, communicating with supply tube, 9, and the outer edge, 8A, of centrifugal feeder, 8, is operated by a transducer (not shown) and is adapted to suction a plurality of wooden tie plugs, 27, from outer edge, 8A, into supply tube, 9. Similarly, bazooka tube, 12, through its transducer, is able to reverse the vacuum suction and effectively remove the wooden tie plugs from the perimeter rim, 8A, when the supply tube is full.

The device also has on-board a compressor, 21, and air tanks, 20, adapted to maintain sufficient air pressure to operate the various suction devices and rams (discussed below) needed to sustain the device and its operation.

Continuing to advert to FIG. 3, the insertion gun, 11, is shown to be generally appended to an armature and pivot, 28, adapted to position the device over the spike hole at a point typically where such spike holes are present and, further, is adapted to lift and remove the insertion gun for safety and traveling purposes when not in use.

Figure 4:
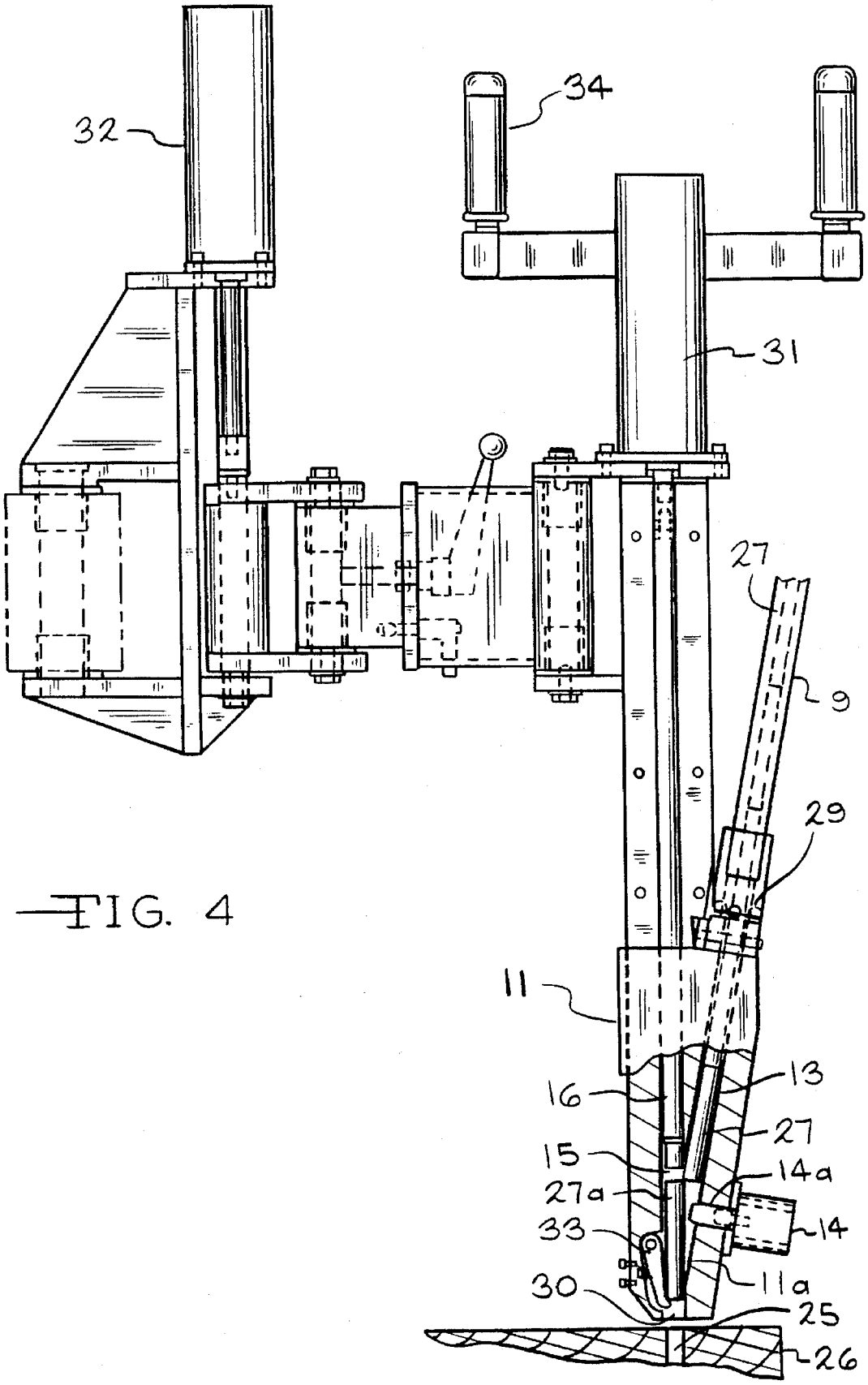
FIG. 4 is a side elevation, in partial cross-section, of the insertion gun portion of the device.

FIG. 4 illustrates the general operation of the insertion mechanism and insert gun, 11, and its attendant components are shown in detail. In particular, supply tube, 9, is shown to contain a series of wooden tie plugs, 27, for insertion. These tie plugs have been fed through centrifugal feeder, 8. As a tie plug progresses through supply tube, 9, and prior to entering insertion tube, 13, a tie plug must pass through alignment bearings, 29. Alignment bearings, 29, comprise a series of spherical bearings arranged around the perimeter of supply tube, 9. As the cylindrical, elongated wooden tie plug, 27, passes through the opening bounded by the spherical beatings, any misalignment of the wooden plugs, 27, is corrected and the tie plug is arranged practically parallel to the internal cylindrical walls of supply tube, 9.

Continuing to advert to FIG. 4, wooden plug, 27, falls into insertion tube, 13, which communicates with supply tube, 9, and represents the final portion of the supply tube and the position just prior to insertion.

Continuing to advert to FIG. 4, a horizontal positioning cylinder, 14, and appended ram, 14A, are shown to extend through the walls of insertion tube, 13. The positioning cylinder, 14, serves two functions: first, it effectively positions the wooden plug to be next inserted in proper position within insertion slot, 15, and further maintains the position of subsequent wooden tie plugs, 27, within insertion tube, 13. Simply, when ram, 14A, is extended, it pushes wooden tie plug, 27A, into position and simultaneously holds tie plug, 27, within the insertion tube until ready. Insertion slot, 15, is shown to communicate, as well, with insertion tube, 13, and provides an opening for vertical ram, 16, powered by cylinder, 31, to move upwardly and downwardly in the vertical direction and to force wooden tie plug, 27A, through insertion gun bottom opening, 30, and into spike hole, 25, with sufficient force for insertion. Assisting with the positioning of the wooden tie plug to be inserted, 27A, is a release mechanism, 33, arranged along the inside wall of insertion slot 15, directly adjacent opening, 30. Release, 33, is biased by a spring or other means to assist in holding wooden tie plug, 27A, in position for insertion and to be selectively moved outwardly away from opening, 30, when downward force is applied by ram, 16. Accordingly the tie plug to be inserted, 27A, is placed into position by ram, 14A, and is supported in the insertion slot through release mechanism, 33, until insertion is accomplished.

Continuing to advert to FIG. 4, the device is shown to further include a set of manual positioning handles, 34, allowing an operator to either pivot or move the device either away from the rails in the case of an emergency or over a particular spike hole if necessary. Moreover, lift cylinder, 32, is adapted to remove the insertion gun, 11, up and away from the track area in the event of an emergency or otherwise. The device may also include an embodiment not shown here, a sensor adapted to automatically trigger lift cylinder, 32, in the event of a jamming of the insertion gun or a malfunction, thereby insuring the mechanism is not damaged during the insertion process.

Accordingly, in operation, a large number of wooden railroad tie plugs are stored in the device and are transported selectively through the use of the conveyer into the centrifugal feeder bin. The bin, having a fixed diameter and an edge adapted to support the wooden tie plugs, is rotated thereby producing centrifugal force and holding the plugs along the perimeter. A suction device, selectively either creating a vacuum or forcing the wooden plugs away from the perimeter, is operable and, when in the vacuum stage, allows the supply tube to become filled with wooden tie plugs to be inserted. As the operator moves the device over the rail, a tie sensor positions the insertion gun over the spike hole in the tie. The position and pivoting mechanism of the gun permits it to be exactly positioned through the use of controls, or automatically, over the typical location of the spike hole at a precise position or distance along the rail.

Once in position, the positioning ram of the device forces a wooden plug to be inserted into an insertion tube containing a ram powered by a hydraulic or other type of air cylinder.

The positioning ram also ensures only one wooden tie plug is positioned within the insertion tube below the ram. A release mechanism further holds the wooden tie plug in position. When operable, the ram, powered by a cylinder, exerts a rapid and significant downward force, thereby powerfully inserting the wooden plug into the spike hole completely, restoring the tie for later insertion of a track spike upon repair or replacement of the rail. The process is repeated over the next tie. The addition of sensors ensures, automatically, that only a certain number of wooden plugs will be interposed within the supply tube or in the centrifugal feeder. The device is further adapted to travel across one or two rails through the use of its crawler mechanism, and the insertion gun may readily and easily be removed or lifted from the rail in the case of malfunction or for purposes of travel.

Accordingly, the present device solves the problem of the prior art when permitting a single operator to automatically, efficiently and easily insert a large number of wooden tie plugs for purposes of rehabilitating railroad ties and to facilitate the replacement or repair of track without the need for replacing any ties or the use of large crews or railroad personnel.

These and other advantages and features of the invention are clearly apparent from the foregoing specification and drawings, as well as the following claims.

I claim:

1. A device for orienting and inserting tie plugs into railroad ties, comprising:

Container means adapted to hold and contain a plurality of tie plugs;

Elevator means communicating with said container means and adapted to convey said tie plugs from said container means to a distant location;

Bin feeder means operatively arranged to receive said plugs from said container means via said elevator means;

Supply means operatively arranged to receive from said bin feeder means a plurality of said plugs for insertion into said railroad ties;

Insertion means operatively arranged to receive from said supply means a plurality of said plugs and adapted to selectively insert said plugs into said railroad ties.

2. The device according to claim 1 further comprising:

Alignment means adapted to position said plug within said insertion means for selective insertion into said railroad tie.

3. The device according to claim 1 further comprising:

Orientation means operatively arranged as part of said supply means and adapted to orient said plug within said supply means in a preselected manner for insertion into said railroad tie.

4. The device according to claim 1 further comprising:

Chassis means adapted to support said device and to travel said device along a preselected length of railroad track and to selectively position said device along a railroad track location.

5. The device according to claim 1 further comprising:

Suction means adapted to selectively transfer a plurality of said plugs from said bin feeder means to said supply means.

6. The device according to claim 1 further comprising:

Means adapted to maintain said tie plugs in a preselected position in said bin feeder means.

7. The device according to claim 1 further comprising:

Positioning means adapted to selectively position said insertion means over a preselected railroad tie for insertion of a plurality of said plugs.

8. The device according to claim 4 further comprising:

Indexing means operatively arranged to position said chassis in relation to a preselected railroad tie.

9. The device according to claim 1 wherein said container means comprises a vessel adapted to hold and contain a plurality of said tie plugs.

10. The device according to claim 1 wherein said elevator means comprises a conveyor communicating with said container means and adapted to remove from said container means a plurality of said tie plugs.

11. The device according to claim 1 wherein said bin feeder means comprises a rotatable bin adapted to receive a plurality of said tie plugs from said container means and to position said tie plugs along the outside perimeter of said bin.

12. The device according to claim 1 wherein said supply means comprises a tube adapted to communicate with said bin feeder means and further adapted to contain a plurality of said tie plugs in a preselected order for insertion.

13. The device according to claim 1 wherein said insertion means comprises a vertical ram.

14. The device according to claim 2 wherein said alignment means comprises a horizontal ram.

15. The device according to claim 3 wherein said orientation means comprises a plurality of balls arranged within said supply means and adapted to orient said tie plug in a preselected manner.

16. The device according to claim 5 wherein said suction means comprises an air suction device adapted to create a vacuum within said supply tube.

17. A device for inserting railroad tie plugs comprising:

Supply means adapted to hold a plurality of said plugs in a preselected orientation;

Alignment means adapted to position a plurality of said plugs within said supply means in a preselected position;

Insertion means adapted to transfer a plurality of said plugs from said supply means into said railroad tie;

Positioning means adapted to position said supply means at a preselected location.

Orientation means comprising a plurality of balls adapted to orient each of said tie plugs within said supply means in a preselected manner.

18. The device according to claim 17 wherein said supply means comprises a tube adapted to contain a plurality of said tie plugs in a preselected orientation.

19. The device according to claim 17 wherein said alignment means comprises a horizontal ram.

20. The device according to claim 17 wherein said insertion means comprises a vertical ram.

21. The device according to claim 17 wherein said positioning means comprises a retractable arm.

22. A method for inserting railroad tie plugs comprising the steps of:

Supplying a plurality of tie plugs for insertion;

Providing a feeding means adapted to selectively feed a plurality of tie plugs for insertion;

Providing an insertion means communicating with said feeding means adapted to receive and insert a plurality of said tie plugs;

Providing a positioning means adapted to position said insertion means at a preselected location for insertion of said tie plugs.

Providing orientation means comprising a plurality of balls operatively adapted to orient said selected tie plug in a particular orientation for insertion.

23. A method for inserting railroad tie plugs according to claim 22 further comprising the steps of:

Providing a ramming means operatively arranged as part of said insertion means for pounding said railroad tie plug for insertion.

24. A method for inserting railroad tie plugs comprising the steps of:

Providing a container for containing a plurality of said railroad tie plugs to be inserted;

Providing a conveyor communicating with said container and for conveying said tie plugs from said container to a distant location;

Providing a bin for receiving said tie plugs from said container by said container;

Providing a suction means from moving from said railroad tie plugs from said bin;

Providing a supply tube operatively connected to said supply bin and adapted to receive from said supply bin suctioned railroad tie plugs to be inserted;

Providing an insertion means operatively connected to said supply tube and adapted to receive a plurality of railroad tie plugs to be inserted;

Providing a ram, operatively connected to said insertion means, and adapted to force said railroad tie plug to be inserted into a specified location.

* * * * *